US012650068B2

(12) United States Patent
Ignova et al.

(10) Patent No.: US 12,650,068 B2
(45) Date of Patent: Jun. 9, 2026

(54) AUTOMATED CONTROL OF TRAJECTORY OF DOWNHOLE DRILLING

(71) Applicant: Schlumberger Technology Corporation, Sugar Land, TX (US)

(72) Inventors: Maja Ignova, Stonehouse (GB); Katharine Mantle, Stonehouse (GB); Ekaterina Brovko, Stonehouse (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/053,475

(22) Filed: Feb. 14, 2025

(65) Prior Publication Data

US 2025/0264015 A1 Aug. 21, 2025

Related U.S. Application Data

(60) Provisional application No. 63/553,731, filed on Feb. 15, 2024.

(51) Int. Cl.

| | |
|---|---|
| ***E21B 44/00*** | (2006.01) |
| ***E21B 7/06*** | (2006.01) |
| ***E21B 47/022*** | (2012.01) |

(52) U.S. Cl.

CPC ..... *E21B 44/00* (2013.01); *E21B 7/06* (2013.01); *E21B 47/022* (2013.01); *E21B 2200/20* (2020.05); *E21B 2200/22* (2020.05)

(58) Field of Classification Search

CPC ..... E21B 7/06; E21B 7/04; E21B 47/022

See application file for complete search history.

(56) References Cited

U.S. PATENT DOCUMENTS

| | | | | |
|---|---|---|---|---|
| 9,273,547 | B2 | 3/2016 | Brooks | |
| 9,404,355 | B2 | 8/2016 | Bayliss | |
| 9,982,525 | B2 | 5/2018 | Brooks | |
| 2015/0218887 | A1 | 8/2015 | Bayliss et al. | |
| 2019/0292898 | A1 * | 9/2019 | Quattrone ..... | G05B 13/0265 |
| 2021/0238926 | A1 | 8/2021 | Zalluhoglu | |
| 2022/0120170 | A1 | 4/2022 | Marck | |
| 2022/0170359 | A1 * | 6/2022 | Boualleg ..... | G06N 20/20 |
| 2022/0349260 | A1 | 11/2022 | Hamzah et al. | |
| 2023/0243251 | A1 * | 8/2023 | Hisham ..... | E21B 7/04 175/24 |

* cited by examiner

*Primary Examiner* — Giovanna Wright

(74) *Attorney, Agent, or Firm* — Jeffrey D. Frantz

(57) ABSTRACT

Methods and systems are provided for automated closed-loop control of drilling trajectory during directional drilling to a geological target, which employ a surface-located predictive controller that interfaces to and cooperates with a downhole trajectory control system to automatically control the drilling direction of a drilling tool during the directional drilling. The predictive controller is configured to receive data representing a new reference trajectory for a given measured depth and generate output data representing a sequence of set-points for the new reference trajectory. The predictive controller is further configured to communicate the output data to the downhole trajectory control system to automatically control the drilling direction of the drilling tool to follow the new reference trajectory.

20 Claims, 10 Drawing Sheets

AUTOMATED CONTROL OF TRAJECTORY OF DOWNHOLE DRILLING

CROSS-REFERENCE TO RELATED APPLICATION(S)

The present disclosure claims priority from U.S. Provisional Appl. No. 63/553,731, filed on Feb. 15, 2024, herein incorporated by reference in its entirety.

FIELD

Disclosed embodiments relate generally to methods for directional control during downhole directional drilling operations.

BACKGROUND

The use of directional drilling methods is becoming increasingly common in drilling subterranean wellbores. One difficulty with directional drilling methods is that they tend to drill (or turn) in a direction offset from the set-point direction. These tendencies can be influenced by numerous factors and may change unexpectedly during a drilling operation. Factors that can influence this directional tendency may include, for example, properties of the subterranean formation, the configuration of the bottom hole assembly (BHA), bit wear, an unplanned touch point (e.g., due to compression and buckling of the BHA), stabilizer-formation interaction, the steering mechanism utilized by the drilling tool, and various drilling parameters.

The steering mechanisms used for directional drilling methods have a toolface which is part of a deflection tool or a steerable motor system. This toolface represents orientation of the deflection tool or steerable motor system in the wellbore and can be controlled to make a desired deflection while drilling a wellbore. In current directional drilling methods, a magnetic toolface can be used to represent orientation of the deflection tool or steerable motor system in the wellbore when the wellbore being drilled has an inclination that is less than a predefined threshold (such as less than 8°), and a gravity toolface can be used to represent orientation of the deflection tool or steerable motor system in the wellbore when the wellbore being drilled has an inclination that is greater than the predefined threshold (such as greater than 8°). Magnetic toolface is a toolface orientation measured as an angle between the tool reference axis and magnetic north in a horizontal plane. Gravity toolface is a toolface orientation measured as an angle between the tool reference axis and gravity in a vertical plane.

Directional drilling methods often transition from drilling a vertical section of the wellbore to a curved or tangent section of the wellbore. This transition is typically referred to as kickoff. In current directional drilling methods, kickoff is typically implemented manually by the drilling operator downlinking a magnetic toolface and steering ratio (SR) parameter. The magnetic toolface represents the direction to drill and the SR parameter represents the time that the steering mechanism will spend in holding the desired magnetic toolface and then drilling ahead adjusting these parameters as required. Once free from magnetic interference, the drilling operator will manually switch from using magnetic toolface to using gravity toolface and continue the drilling sending gravity toolface and SR parameters as required. Sometimes, this manual transition from magnetic toolface to gravity toolface can cause anomalies to inclination and azimuth smoothness as well as anomalies in consistency of dog leg severity of the wellbore in the kickoff.

SUMMARY

Methods and systems are provided for automated closed-loop control of drilling trajectory during directional drilling to a geological target, which employ a surface-located predictive controller that interfaces to and cooperates with a downhole trajectory control system to automatically control the direction of a drilling tool during the directional drilling. The predictive controller is configured to receive data representing a new reference trajectory for a given measured depth and generate output data representing a sequence of set-points for the new reference trajectory. The predictive controller is further configured to communicate the output data to the downhole trajectory control system to automatically control the drilling direction of the drilling tool to follow the new reference trajectory.

In embodiments, the drilling tool can include an RSS system.

In embodiments, the set-points specify at least one of the following for the new reference trajectory: dog leg severity, toolface, target inclination, and target azimuth.

In embodiments, the downhole trajectory control system can include an auto-curve controller that uses set-points of dog leg severity or tool face for the new reference trajectory to automate drilling of curved segments of the new reference trajectory.

In embodiments, the downhole trajectory control system can include an attitude controller that uses set-points of target inclination and target azimuth for the new reference trajectory to automate drilling of segments of the new reference trajectory.

In embodiments, the attitude controller can implement a closed-loop HIA control scheme.

In embodiments, the predictive controller can include a model and optimizer.

In embodiments, the model can embody a transfer function for at least one closed-loop controller of the downhole trajectory control system. The transfer function can be configured to account for response of the at least one closed-loop controller to input data supplied thereto.

In embodiments, the model can be configured to account for a variable sampling rate of the at least one closed-loop controller.

In embodiments, the at least one closed-loop controller can include an attitude controller that implements a closed-loop HIA control scheme.

In embodiments, the model can be configured with different set-point excitations.

In embodiments, the model can be supplied with past and future inputs that represent DLS and TF set-points.

In embodiments, the future inputs can represent optimized values for DLS and TF set-points that will minimize error between a reference trajectory (or position) and a predicted trajectory path.

In embodiments, the model can be configured to predict future outputs that represent inclination response and azimuth response of the downhole trajectory control system.

In embodiments, the model and optimizer can be configured to perform a model-based predictive control method that produces DLS and TF set-points over certain MD segments that minimize error between the new reference trajectory and a predicted trajectory based on the model.

In embodiments, the new reference trajectory and the predicted trajectory can be defined by at least one parameter selected from the group consisting of: true vertical depth (TVD), north/south and east/west, new reference inclination and/or azimuth, measured depth (MD) and vertical section (VS), or changes related to these parameters.

In embodiments the model and optimizer can employ convex optimization that include constraints and a cost function.

In embodiments, the cost function can be constructed as a combination of the difference of the reference and predicted trajectory and sum of the changes in the inputs to the model.

In embodiments, the cost function can be configured to minimize the number of changes in DLS and TF to reach the geological target.

In embodiments, the predictive controller and or the downhole trajectory control system can be embodied by a processor or controller.

The disclosed embodiments may provide various technical advantages. For example, the disclosed methods may provide for improved well placement and reduced wellbore tortuosity. Moreover, by providing for closed loop control, the disclosed methods tend to improve drilling efficiency and consistency.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

For a more complete understanding of the disclosed subject matter, and advantages thereof, reference is now made to the following descriptions taken in conjunction with the accompanying drawings, in which.

DETAILED DESCRIPTION

The particulars shown herein are by way of example and for purposes of illustrative discussion of the embodiments of the subject disclosure only and are presented in the cause of providing what is believed to be the most useful and readily understood description of the principles and conceptual aspects of the subject disclosure. In this regard, no attempt is made to show structural details in more detail than is necessary for the fundamental understanding of the subject disclosure, the description taken with the drawings making apparent to those skilled in the art how the several forms of the subject disclosure may be embodied in practice. Furthermore, like reference numbers and designations in the various drawings indicate like elements.

Figure 1:
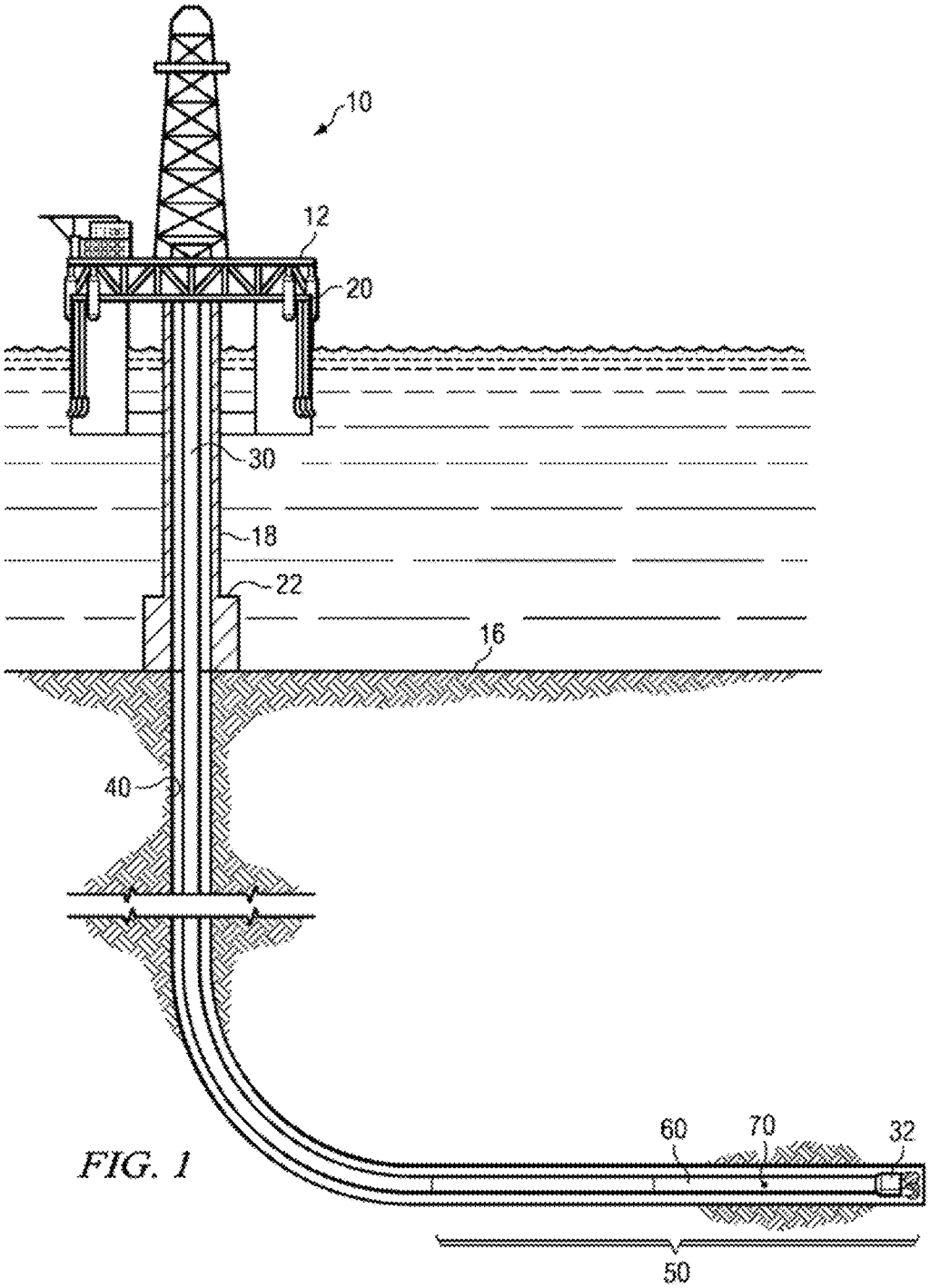
FIG. 1 depicts an example drilling rig on which disclosed embodiments may be utilized.

FIG. 1 depicts a drilling rig 10 suitable for using various method and system embodiments disclosed herein. A semi-submersible drilling platform 12 is positioned over an oil or gas formation (not shown) disposed below the sea floor 16. A subsea conduit 18 extends from deck 20 of platform 12 to a wellhead installation 22. The platform may include a derrick and a hoisting apparatus for raising and lowering a drill string 30, which, as shown, extends into wellbore 40 and includes a bottom hole assembly (BHA) 50. The BHA 50 includes a drill bit 32, a steering tool 60 (also referred to as a directional drilling tool), and one or more downhole navigation sensors 70 such as measurement while drilling sensors including three axis accelerometers and/or three axis magnetometers. The BHA 50 may further include substantially any other suitable downhole tools such as a downhole drilling motor, a downhole telemetry system, a reaming tool, and the like. The disclosed embodiments are not limited with regard to such other tools.

It will be understood that the BHA may include substantially any suitable steering tool 60, for example, a deflection tool or a rotary steerable system. Various rotary steerable tool configurations are known in the art including various steering mechanisms for controlling the direction of drilling.

For example, in one embodiment, the BHA 50 may include a deflector tool that includes a substantially non-rotating outer housing employing blades that engage the wellbore wall. Engagement of the blades with the wellbore wall can be controlled to vary the attitude of the drill bit during drilling, thereby pointing or pushing the drill bit in a desired direction while drilling. A rotating shaft deployed in the outer housing transfers rotary power and axial weight-on-bit to the drill bit during drilling. Accelerometer and magnetometer sets may be deployed in the outer housing and therefore are non-rotating or rotate slowly with respect to the wellbore wall.

In another embodiment, the BHA 50 can include a rotary steerable system, such as the PowerDrive rotary steerable system available from SLB which fully rotates with the drill string (i.e., the outer housing rotates with the drill string). The PowerDrive Xceed makes use of an internal steering mechanism that is not requiring contact with the wellbore wall and enables the tool body to fully rotate with the drill string. The PowerDrive® X5, X6, and PowerDrive Orbit rotary steerable systems make use of mud actuated blades (or pads) that contact the wellbore wall. The extension of the blades (or pads) is rapidly and continually adjusted as the system rotates in the wellbore. The PowerDrive Archer makes use of a lower steering section joined at an articulated swivel with an upper section. The swivel is actively tilted via pistons so as to change the angle of the lower section with respect to the upper section and maintain a desired drilling direction as the bottom hole assembly rotates in the wellbore. Accelerometer and magnetometer sets may rotate with the drill string or may alternatively be deployed in an internal roll-stabilized housing such that they remain substantially stationary (in a bias phase) or rotate slowly with respect to the wellbore (in a neutral phase). To drill a desired curvature, the bias phase and neutral phase are alternated during drilling at a predetermined ratio (referred to as the steering ratio). Again, the disclosed embodiments are not limited to use with any particular steering tool configuration.

The downhole sensors 70 may include substantially any suitable sensor arrangement used for making downhole navigation measurements (wellbore inclination, wellbore azimuth, and/or tool face measurements). Such sensors may include, for example, accelerometers, magnetometers, gyroscopes, and the like. Such sensor arrangements are well known in the art and are therefore not described in further detail. The disclosed embodiments are not limited to the use of any particular sensor embodiments or configurations. Methods for making real-time while drilling measurements of the wellbore inclination and wellbore azimuth are disclosed, for example, in commonly assigned U.S. Pat. Nos. 9,273,547B2 and 9,982,525B2. In the depicted embodiment, the sensors 70 are shown to be deployed in the steering tool 60. Such a depiction is merely, for convenience, as the sensors 70 may be deployed elsewhere in the BHA.

It will be understood by those of ordinary skill in the art that the deployment illustrated on FIG. 1 is merely an example. It will be further understood that disclosed embodiments are not limited to use with a semisubmersible platform 12 as illustrated in FIG. 1. The disclosed embodiments are equally well suited for use with any kind of subterranean drilling operation, either offshore or onshore.

Figure 2:
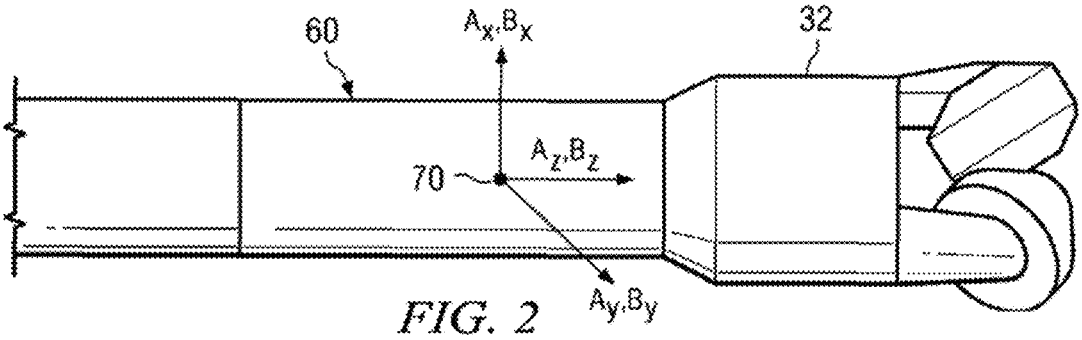
FIG. 2 depicts a lower BHA portion of the drill string shown on FIG. 1.

FIG. 2 depicts the lower BHA portion of drill string 30 including drill bit 32 and steering tool 60. As described above with respect to FIG. 1, the steering tool may include navigation sensors 70 including tri-axial (three axis) accelerometer and magnetometer sensors. Suitable accelerometers and magnetometer sensors may be chosen from among substantially any suitable commercially available devices known in the art. FIG. 2 further includes a diagrammatic representation of the tri-axial accelerometer and magnetometer sensor sets. By tri-axial it is meant that each sensor set includes three mutually perpendicular sensors, the accelerometers being designated as $A_x$, $A_y$, and $A_z$ and the magnetometers being designated as $B_x$, $B_y$, and $B_z$. By convention, a right handed system is designated in which the z-axis accelerometer and magnetometer ($A_z$ and $B_z$) are oriented substantially parallel with the wellbore as indicated (although disclosed embodiments are not limited by such conventions). Each of the accelerometer and magnetometer sets may therefore be considered as determining a plane (the x and y-axes) and a pole (the z-axis along the axis of the BHA).

Figure 3:
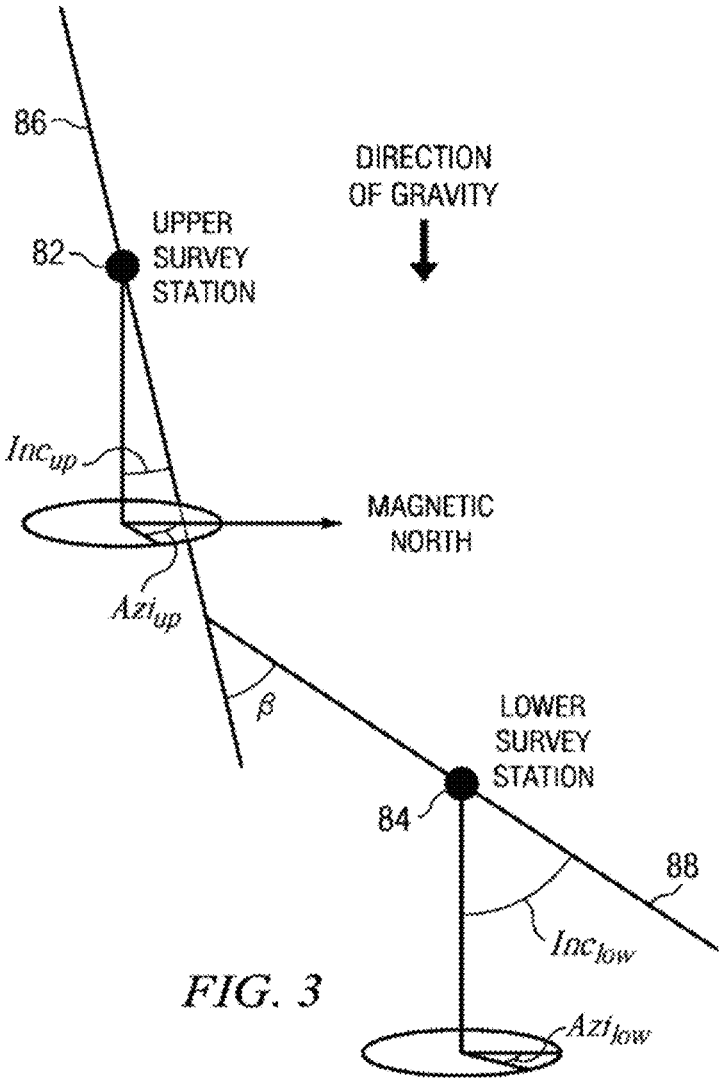
FIG. 3 depicts a diagram of attitude and steering parameters in a global coordinate reference frame.

FIG. 3 depicts a diagram of attitude in a global coordinate reference frame at first (upper) and second (lower) survey stations 82, 84, respectively. The attitude of a BHA defines the orientation of the BHA axis (axis 86 at the upper survey station 82 and axis 88 at the lower survey station 84) in three-dimensional space. In wellbore surveying applications, the wellbore attitude represents the direction of the BHA axis in the global coordinate reference frame (and is commonly understood to be approximately equal to the direction of propagation of the drill bit). Attitude may be represented by a unit vector the direction of which is often defined by the wellbore inclination and the wellbore azimuth. In FIG. 2 the wellbore inclination at the upper and lower survey stations 82, 84 is represented by $Inc_{up}$ and $Incl_{ow}$, while the wellbore azimuth is represented by $Azi_{up}$ and $Azi_{low}$. The angle β represents the overall angle change of the wellbore between the first and second survey stations 82, 84.

Figure 4:
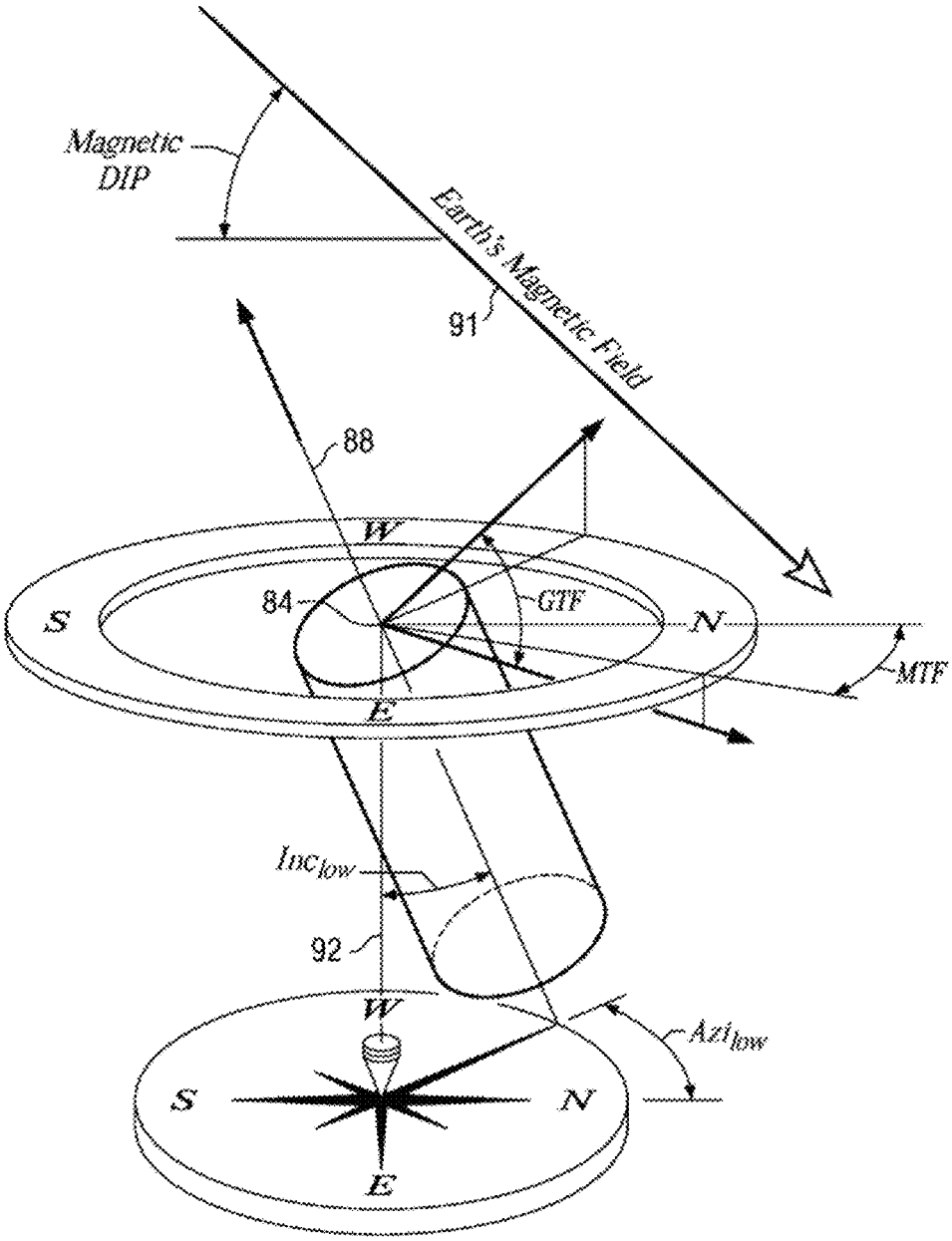
FIG. 4 depicts a diagram of gravity toolface and magnetic toolface in a global reference frame.

FIG. 4 depicts a further diagram of attitude and toolface in a global coordinate reference frame at the second lower survey station 84. The Earth's magnetic field and gravitational field are illustrated as vectors 91, 92, respectively. The wellbore inclination $Incl_{ow}$ represents the deviation of axis 88 from vertical, while the wellbore azimuth $Azil_{ow}$ represents the deviation of a projection of the axis 88 on the horizontal plane from magnetic north. Gravity toolface (GTF) is the angular deviation about the circumference of some component of the downhole tool with respect to the highside (HS) of the tool collar (or wellbore). In this disclosure, gravity tool face (GTF) represents the angular deviation between the direction towards which the drill bit is being turned and the highside direction (e.g., in a slide drilling operation, the gravity tool face represents the angular deviation between a bent sub-scribe line and the highside direction). Magnetic toolface (MTF) is similar to GTF but uses magnetic north as a reference direction. In particular, MTF is the angular deviation in the horizontal plane between the direction towards which the drill bit is being turned and magnetic north as shown.

It will be understood that the disclosed embodiments are not limited to the above-described conventions for defining wellbore coordinates depicted in FIGS. 2, 3, and 4. It will be further understood that these conventions can affect the form of certain of the mathematical equations that follow in this disclosure. Those of ordinary skill in the art will be readily able to utilize other conventions and derive equivalent mathematical equations.

In current practices, directional drilling operations have used manual commands communicated from a surface controller to a downhole controller that adjusts the toolface and the steering ratio of the tool (i.e., RSS system) to land the well and then activate an HIA control loop in the downhole controller that continuously and automatically holds a target inclination angle and target azimuth angle of the tool (i.e., RSS system/steering unit) when the bit is projected to be at landing point.

Figure 5:
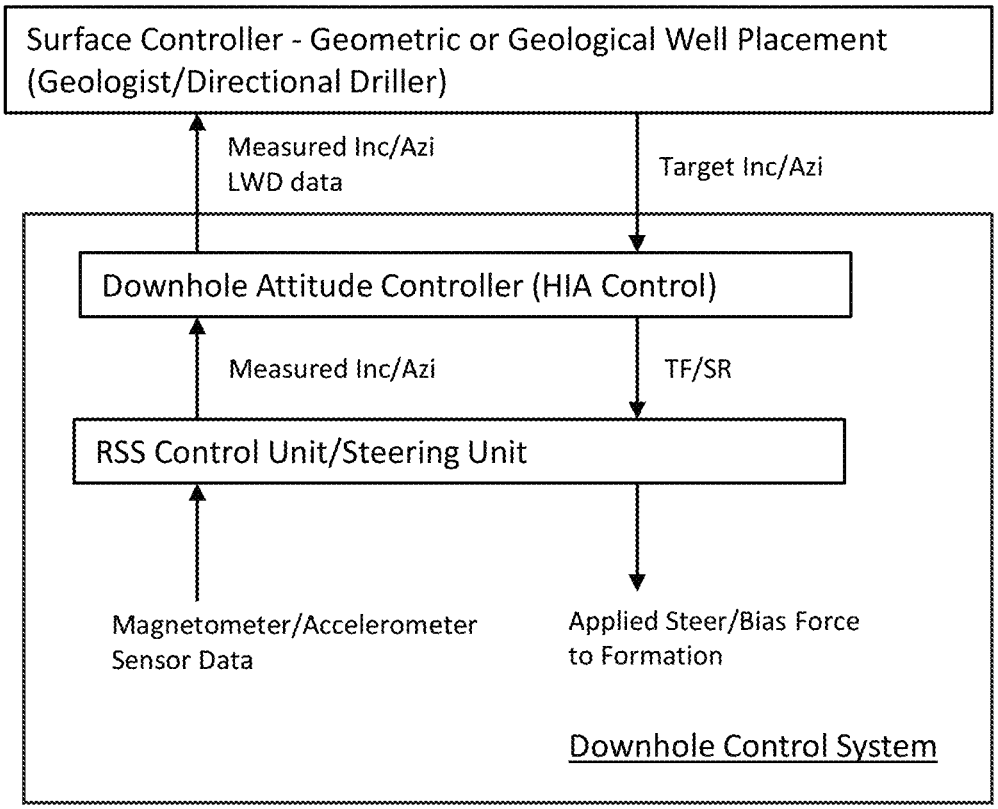
FIG. 5 is a block diagram of a prior art control system for controlling the drilling trajectory while drilling.

FIG. 5 illustrates an example control system that is configured to implement this method of geosteering. Data representing a set-point of target inclination and azimuth is communicated to a downhole attitude controller, which implements the HIA control loop that automatically holds the target inclination angle and target azimuth angle of the tool (i.e., RSS system/steering unit) by adjusting the toolface and the steering ratio of the tool based on continuous real-time measurement of inclination and azimuth derived from magnetometer/accelerometer sensor data measured by the tool. This reduces reliance on a previously computed survey model and the need to stop drilling to take individual confirmation (static) surveys with conventional measurement-while-drilling (MWD) tools. However, the downhole attitude controller which implements the HIA control loop can have its own steering dynamics that can lead to variation in the performance of the geo-steering response of the tool and thus produce non-optimal trajectory.

Figure 6:
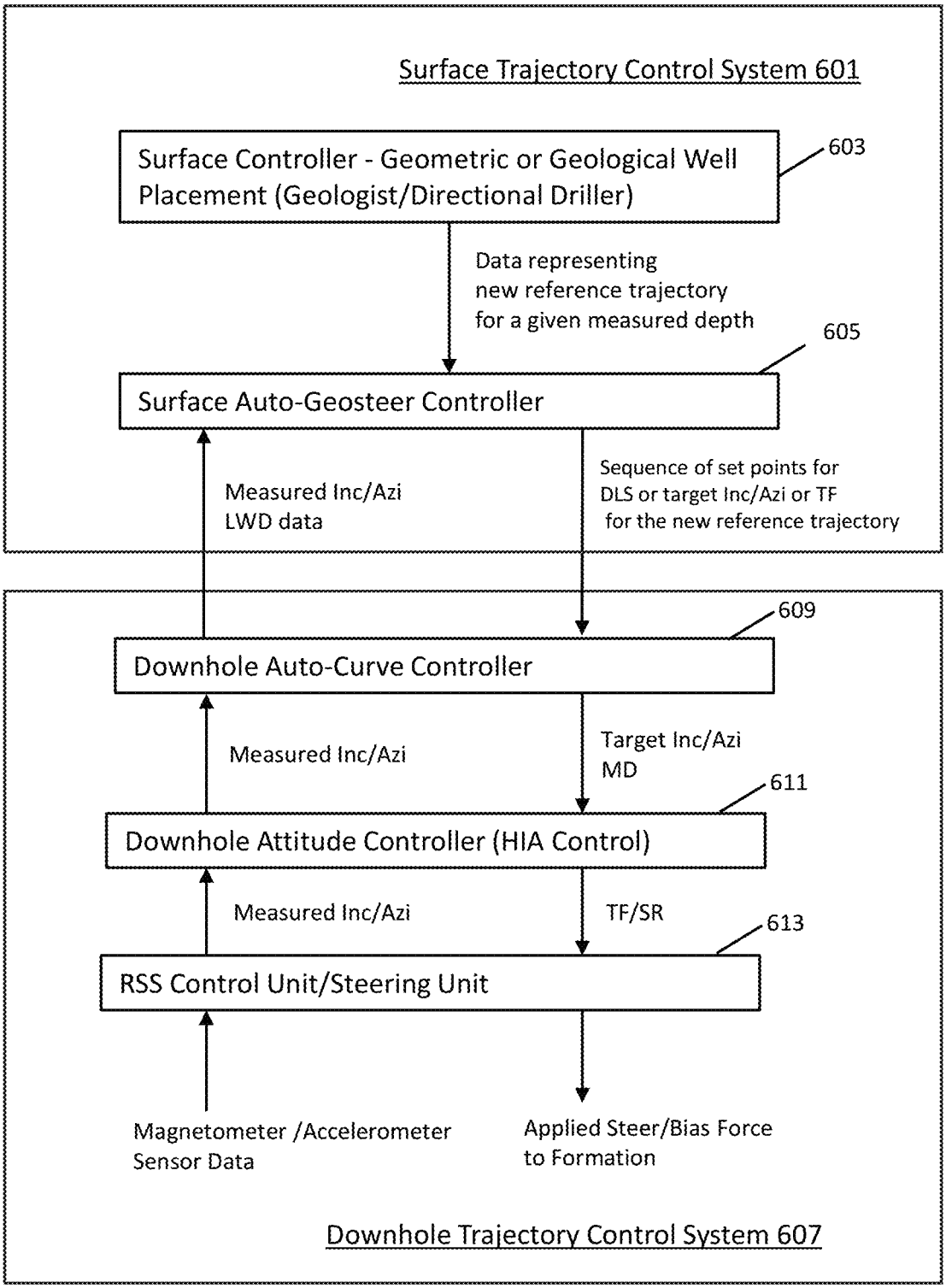
FIG. 6 is a block diagram of a control system for controlling the drilling trajectory while drilling that implements automated control methods of the present disclosure.

The present disclosure describes a closed-loop control method for automatic execution of directional drilling operations to a given geological target. It employs a surface-located predictive controller that interfaces to and cooperates with a downhole trajectory control system to automatically control drilling direction of a drilling tool (i.e., RSS system/steering unit). The predictive controller is configured to receive data representing a new reference trajectory for a given measured depth and generate output data representing a sequence of set-points for the new reference trajectory. In embodiments, the set-points can specify dog leg severity (DLS) or toolface (TF) or target inclination and target azimuth for the new reference trajectory. The output data is communicated to the downhole trajectory control system to automatically control the drilling direction of the drilling tool (i.e., RSS system/steering unit) to follow the new reference trajectory. FIG. 6 illustrates an example control system that can implement this method of geosteering.

The system of FIG. 6 includes a surface trajectory control system 601 located at the surface and a downhole trajectory control system 607 that is part of the downhole tool located in the wellbore being drilled. The surface trajectory control system 601 communicates and cooperates with the downhole trajectory control system 607 to provide closed-loop control of drilling trajectory during directional drilling.

The surface trajectory control system 601 includes a surface controller 603 and a surface auto-geosteer controller 605. The surface controller 603 is configured to interact with a geologist and/or directional driller to output data representing a new reference trajectory for a given measured depth. This new reference trajectory can be based on a previously computed survey model with possible updates based on the measured inclination and azimuth of the actual trajectory of the drilling operations and possibly other logging while drilling measurements. For example, the new reference trajectory can be specified by human input or by a computer program. The new reference trajectory can change dynamically while drilling based on new information obtained from real-time logging while drilling information and combined with an existing sub-surface model. The new reference trajectory can be a simple trajectory, e.g., TVD change, or a more complex path re-planning.

The surface auto-geosteer controller 605 is a predictive controller that receives data representing the new reference trajectory from the surface controller 601 and generates output data representing a sequence of set-points for the new reference trajectory. In embodiments, the set-points can specify dog leg severity (DLS) or toolface (TF) or target inclination and azimuth for the new reference trajectory. The output data is communicated (e.g., downlinked) to the downhole trajectory control system 607 to automatically control the direction of the tool (i.e., RSS system/steering unit) to follow the new reference trajectory.

The downhole trajectory control system 607 includes a downhole auto-curve controller 609, a downhole attitude controller 611, and an RSS control unit/steering unit 613. The downhole auto-curve controller 609 can use the set-points of dog leg severity (DLS) or tool face (TF) for the new reference trajectory to cooperate with the downhole control elements (downhole attitude controller 611 and RSS control unit/steering unit 613) to automate the drilling of curved segments of the new reference trajectory. The downhole attitude controller 611 can use the set-points of target inclination and target azimuth for the new reference trajectory to cooperate with the RSS control unit/steering unit 613 to automate the drilling of one or more segments (such as lateral or horizontal segments) of the new reference trajectory. The RSS control unit/steering unit 613 employs inputs of toolface (TF) demand and steering power output from the downhole attitude controller 611 to control the toolface (TF) of the drilling tool to correspond to the new reference trajectory.

In embodiments, the attitude controller 611 can implement an HIA control loop that automatically holds the target inclination angle and target azimuth angle of the tool (i.e., RSS system/steering unit) by adjusting the toolface and the steering ratio of the tool based on continuous real-time measurement of inclination and azimuth derived from magnetometer/accelerometer sensor data measured by the tool.

In embodiments, the surface auto-geosteer controller 605 can be designed as a predictive controller that includes a model and optimizer. In embodiments, the model can embody a transfer function of the attitude controller 611, with different set-point excitations (such as step, ramp, or any non-linear function). The model can be configured to account for a variable sampling rate of the attitude controller 611, which can be adapted for a range of telemetry rates, such as very frequent telemetry updates provided by wired drill pipe or lower frequency telemetry updates (allowing only a few discrete steps to reach the target) provided by other telemetry mechanisms.

Figure 7:
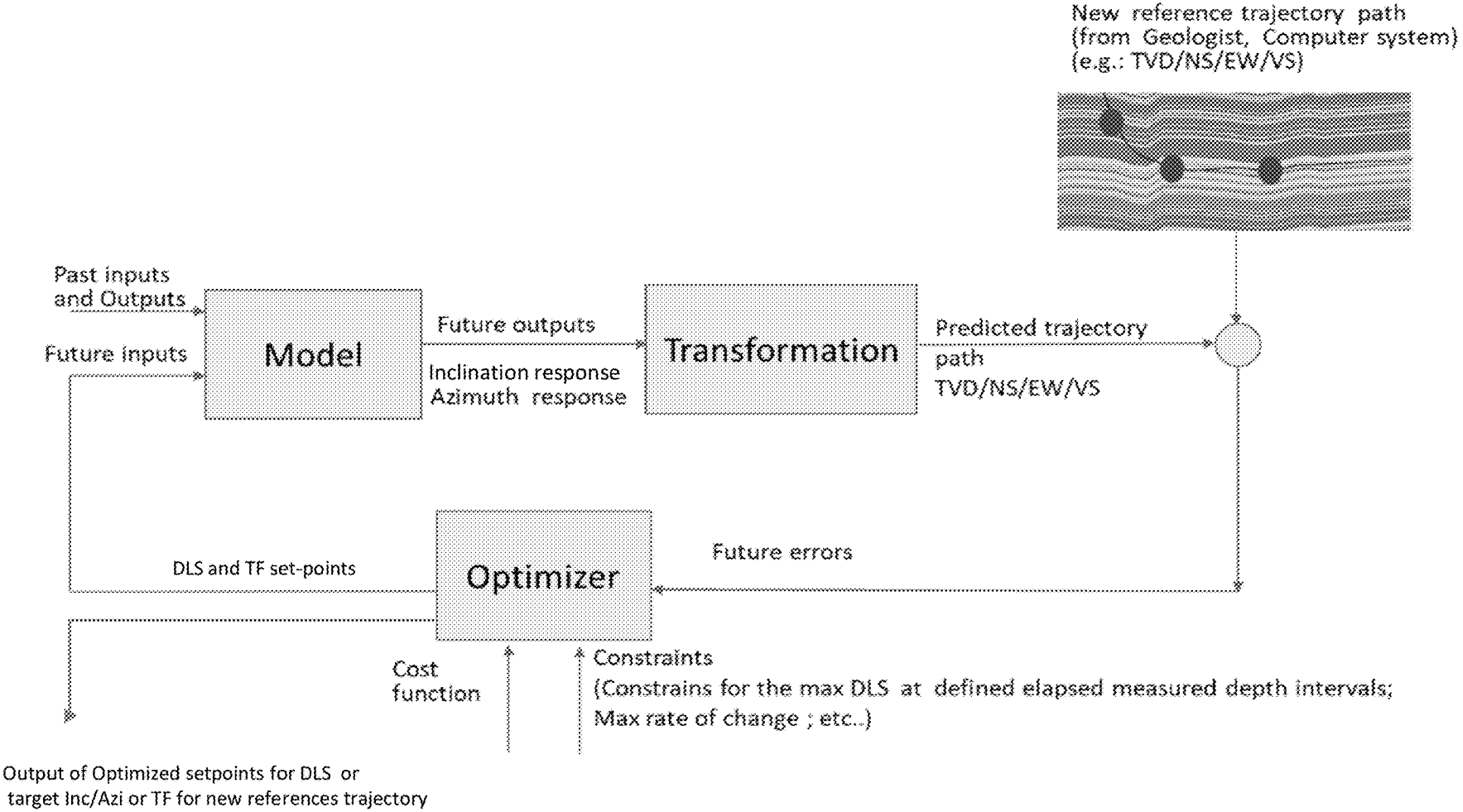
FIG. 7 is a schematic diagram illustrating an embodiment of the auto-geosteer controller of FIG. 6.

FIG. 7 illustrates an example structure for the auto-geosteer controller 605 of FIG. 6, which employs a model that is supplied with past inputs and outputs as well as future inputs. The past inputs are the DLS and TF set-points, which translate to inclination and azimuth set-points versus measured depth intervals. The future inputs are generated by an optimizer. The future inputs represent optimized values for DLS and TF set-points that will minimize the error between a reference trajectory (or position) and a predicted trajectory path. The model is configured to predict future outputs that represent inclination response and azimuth response of the downhole trajectory control system 607. The model and optimizer can be configured to perform a model-based predictive control method (for example, which can employ convex optimization) that produces DLS and TF set-points over certain elapsed MD segments that minimize the error between the new reference trajectory and a predicted trajectory based on the model. The new reference trajectory and the predicted trajectory can be defined by one or more parameters, such as true vertical depth (TVD), north/south and east/west, new reference inclination and/or azimuth, measured depth (MD) and vertical section (VS), or changes related to these parameters. In embodiments, the model-based predictive control method can employ convex optimization, which can include constraints and a cost function. The cost function can be constructed as a combination of the difference of the reference and predicted trajectory and sum of the changes in the inputs to the model, such as DLS and TF changes over the given control horizon. The cost function can be configured to minimize the number of changes in DLS and TF to reach the geological target. The auto-geosteer controller 605 can be configured to repeat the model-based predictive control method once the downlink of the output data representing the sequence of set-points for the new reference trajectory is received by the downhole trajectory control system 607.

Figure 8:
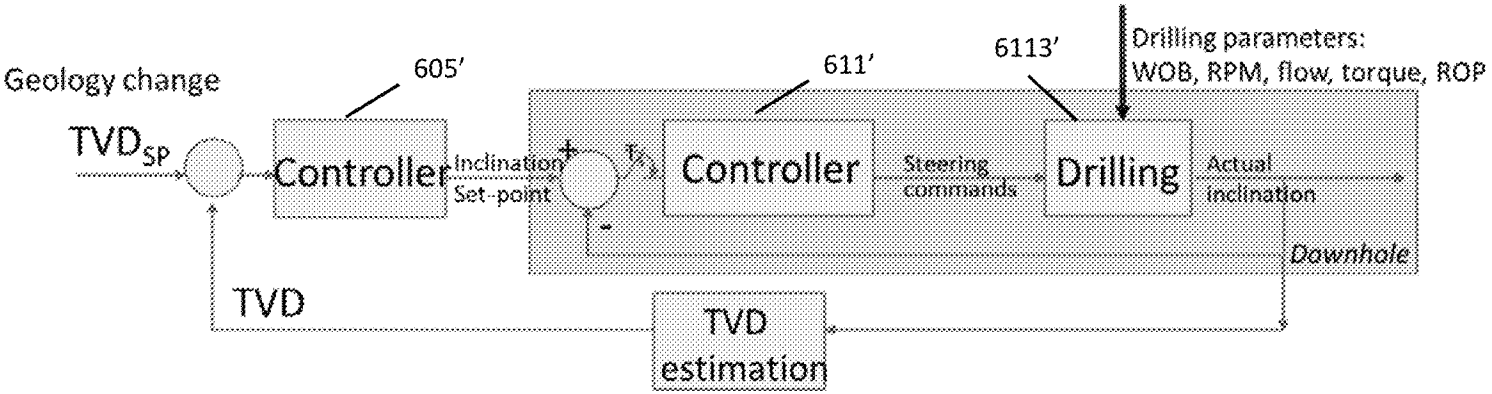
FIG. 8 is a schematic diagram of a control system for controlling the drilling trajectory while drilling that implements automated control methods of the present disclosure.

FIG. 8 illustrates an example embodiment of a control system that controls the drilling direction of the drilling tool (i.e., RSS system/steering unit), which employs an auto-geosteer controller 605' for the case where the reference trajectory is a change in TVD set-point. In this case, the output of the auto-geosteer controller 605' represents set-points for the target inclination and target azimuth (or change therein) of the drilling tool that corresponds to the change in TVD set-point. In this case, the computation of the set-points for the target inclination and target azimuth by the controller 605' accounts for the expected response of the drilling tool as experienced by the closed-loop attitude controller 611'.

Figure 9:
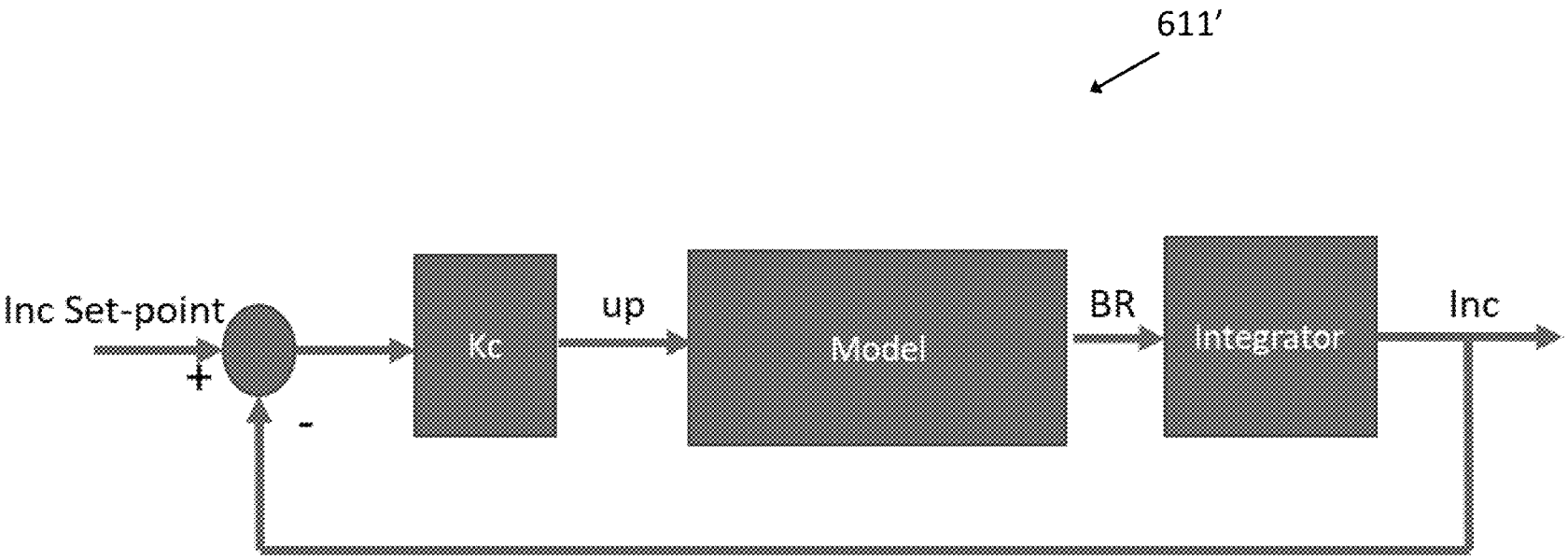
FIG. 9 is a schematic diagram of the downhole attitude controller of the control system of FIG. 8.
Figure 10:
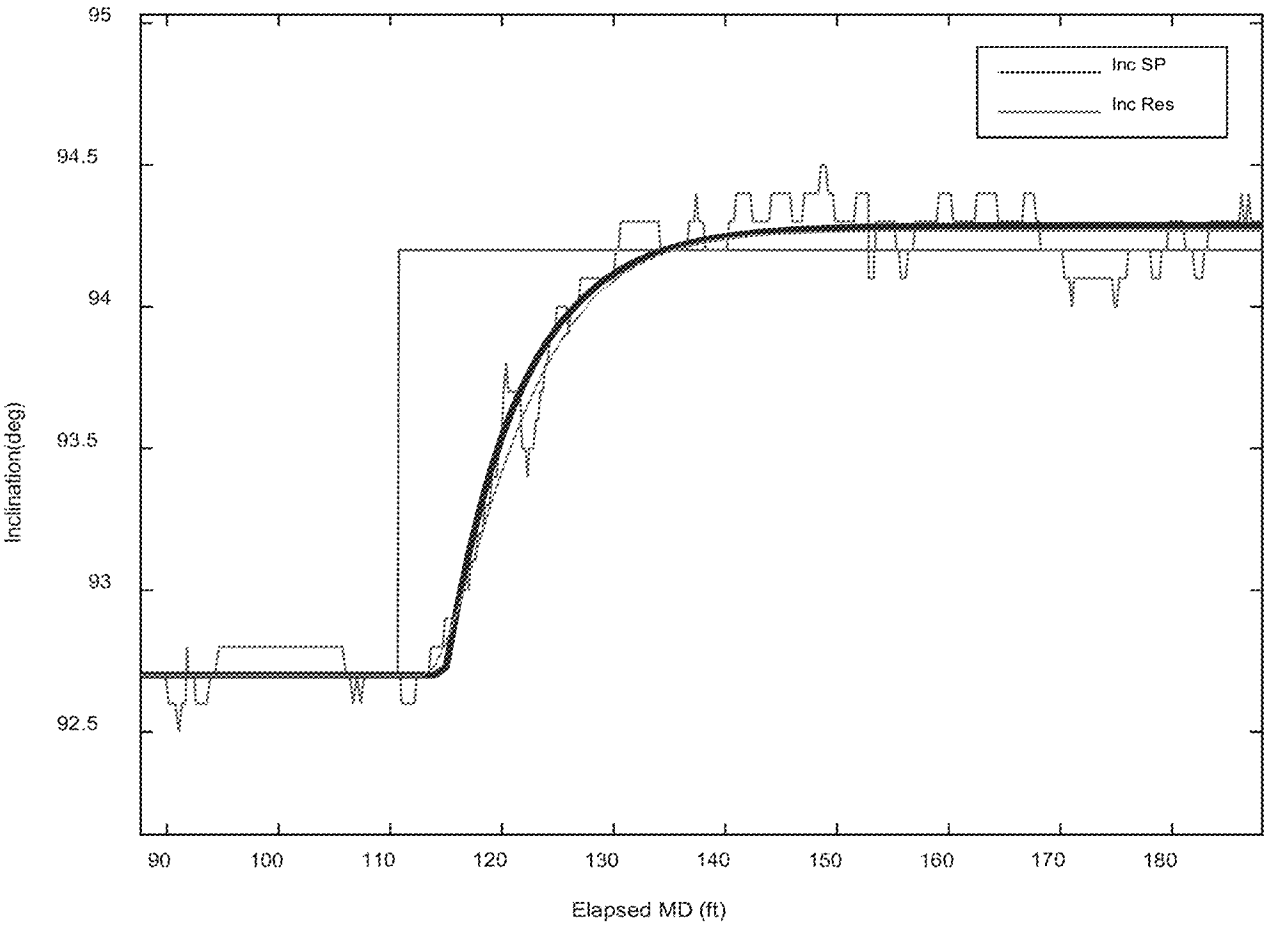
FIG. 10 is a plot illustrating response of the attitude controller of FIG. 9 with respect to a step-change in inclination set-point.

FIG. 9 shows an embodiment of the attitude controller 611' of FIG. 8, which provides for closed-loop control of inclination of the drilling tool using a feedback closed-loop approach with proportional gain. BR is the build rate as a function of steering that is applied to the drilling tool. The response of this closed-loop attitude controller 611' is illustrated in FIG. 10. In the plot of FIG. 10, the step-change in the inclination set-point and real-time response of the inclination of the RSS tool and black-line is the superimposed model simulation to a step-change using the formula of Eqn. (1) below. For this example, the model is estimated from the real-data as having $K_p$=1.06; time-constant=6.78 ft. The transfer function of this closed-loop system (the model for the predictive controller) is:

$$\frac{Inc(s)}{Inc_{sp}(s)} = \frac{K_c \cdot \text{Gain} \cdot \frac{1}{s}}{1 + K_c \cdot \text{Gain} \cdot \frac{1}{s}} = \frac{1}{\frac{1}{K_c \cdot \text{Gain}} \cdot s + 1} \quad \text{Eqn. (1)}$$

where Gain is the gain of the closed-loop control in deg/ft;

$$Kc = (\text{output steering power})/(Inc_{sp} - Inc);$$

s is a Laplace operator, which can be discretized from the model based on the sampling rates; note that any standard continuous to discrete methods can be used;

$Inc_{sp}$ is a set-point of inclination (target inclination) in the attitude controller; and Inc is the inclination measured by the drilling tool.

The operation of the auto-geosteer controller 605' can also estimate MD when the TVD target (or the 3-targets) will be reached. This is a GPS-like estimate.

Note that the transfer function of Eqn. (1) can be used to estimate the changes of inclination and azimuth responses of the tool as a function of changes in the set-point of target inclination and target azimuth, which along with MD gives prediction of the changes of the TVD. The same can be extended to any 3-D trajectory reference change.

The embodiments described herein can be configured for implementation via one or more controllers deployed at the surface and downhole (e.g., in a steering/directional drilling tool). A suitable controller may include, for example, a programmable processor, such as a microprocessor or a microcontroller and processor-readable or computer-readable program code embodying logic. A suitable processor may be utilized, for example, to execute the method embodiments described above. A suitable controller may also optionally include other controllable components, such as sensors (e.g., a depth sensor), data storage devices, power supplies, timers, and the like. The controller may also be disposed in electronic communication with the attitude sensors (e.g., to receive the continuous inclination and azimuth measurements). A suitable controller may also optionally communicate with other instruments in the drill string, such as, for example, telemetry systems that communicate with the surface. A suitable controller may optionally include volatile or non-volatile memory or a data storage device.

The disclosed embodiments may further include a downhole steering tool having a downhole steering tool body, a steering mechanism for controlling a direction of drilling a subterranean wellbore and sensors for measuring attitude (i.e., inclination and azimuth) of the wellbore as it is drilled. The steering tool may further include a downhole controller including one or more modules that embody a cascade closed-loop control system to control the direction of drilling as described herein.

Figure 11:
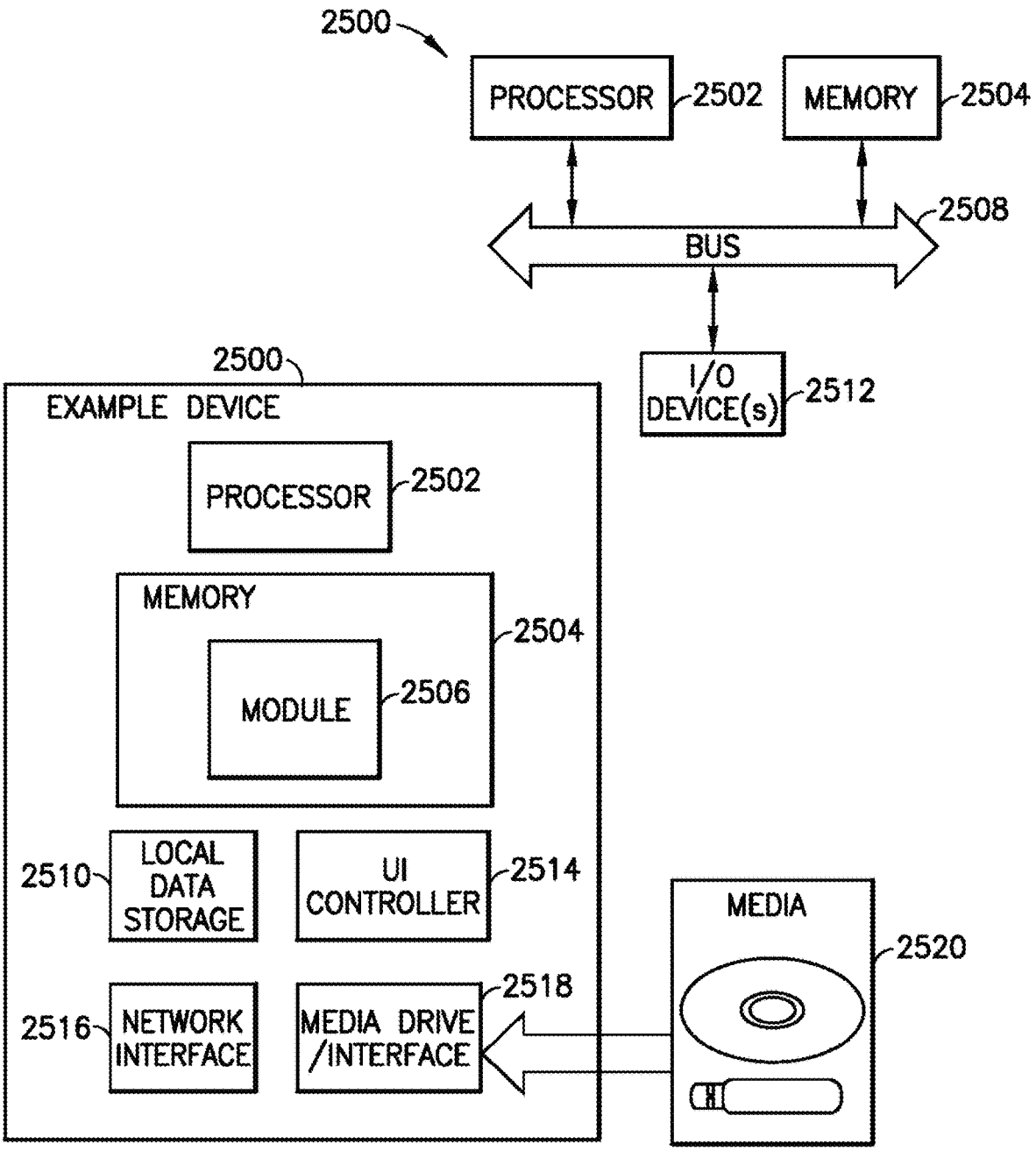
FIG. 11 is a schematic diagram of a computer processing system.

FIG. 11 illustrates an example device 2500, with a processor 2502 and memory 2504 that can be configured to implement various embodiments of the processes and systems as discussed in the present application. For example, various steps or operations of the processes or systems described herein can be embodied by computer program instructions (software) that execute on the device 2500. Memory 2504 can also host one or more databases and can include one or more forms of volatile data storage media such as random-access memory (RAM), and/or one or more forms of nonvolatile storage media (such as read-only memory (ROM), flash memory, and so forth).

Device 2500 is one example of a computing device or programmable device and is not intended to suggest any limitation as to scope of use or functionality of device 2500 and/or its possible architectures. For example, device 2500 can comprise one or more computing devices, programmable logic controllers (PLCs), etc.

Further, device 2500 should not be interpreted as having any dependency relating to one or a combination of components illustrated in device 2500. For example, device 2500 may include one or more computers, such as a laptop computer, a desktop computer, a mainframe computer, etc., or any combination or accumulation thereof.

Device 2500 can also include a bus 2508 configured to allow various components and devices, such as processors 2502, memory 2504, and local data storage 2510, among other components, to communicate with each other.

Bus 2508 can include one or more of any of several types of bus structures, including a memory bus or memory controller, a peripheral bus, an accelerated graphics port, and a processor or local bus using any of a variety of bus architectures. Bus 2508 can also include wired and/or wireless buses.

Local data storage 2510 can include fixed media (e.g., RAM, ROM, a fixed hard drive, etc.) as well as removable media (e.g., a flash memory drive, a removable hard drive, optical disks, magnetic disks, and so forth). One or more input/output (I/O) device(s) 2512 may also communicate via a user interface (UI) controller 2514, which may connect with I/O device(s) 2512 either directly or through bus 2508.

In one possible implementation, a network interface 2516 may communicate outside of device 2500 via a connected network. A media drive/interface 2518 can accept removable tangible media 2520, such as flash drives, optical disks, removable hard drives, software products, etc. In one possible implementation, logic, computing instructions, and/or software programs comprising elements of module 2506 may reside on removable media 2520 readable by media drive/interface 2518.

In one possible embodiment, input/output device(s) 2512 can allow a user (such as a human annotator) to enter commands and information to device 2500, and also allow information to be presented to the user and/or other components or devices. Examples of input device(s) 2512 include, for example, sensors, a keyboard, a cursor control device (e.g., a mouse), a microphone, a scanner, and any other input devices known in the art. Examples of output devices include a display device (e.g., a monitor or projector), speakers, a printer, a network card, and so on.

Various processes and systems of present disclosure may be described herein in the general context of software or program modules, or the techniques and modules may be implemented in pure computing hardware. Software generally includes routines, programs, objects, components, data structures, and so forth that perform particular tasks or implement particular abstract data types. An implementation of these modules and techniques may be stored on or transmitted across some form of tangible computer-readable media. Computer-readable media can be any available data storage medium or media that is tangible and can be accessed by a computing device. Computer readable media may thus comprise computer storage media. "Computer storage media" designates tangible media, and includes volatile and non-volatile, removable, and non-removable tangible media implemented for storage of information such as computer readable instructions, data structures, program modules, or other data. Computer storage media include, but are not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other tangible medium which can be used to store the desired information, and which can be accessed by a computer.

Some of the methods and processes described above can be performed by a processor. The term "processor" should not be construed to limit the embodiments disclosed herein to any particular device type or system. The processor may include a computer system. The computer system may also include a computer processor (e.g., a microprocessor, microcontroller, digital signal processor, general-purpose computer, special-purpose machine, virtual machine, software container, or appliance) for executing any of the methods and processes described above.

The computer system may further include a memory such as a semiconductor memory device (e.g., a RAM, ROM, PROM, EEPROM, or Flash-Programmable RAM), a magnetic memory device (e.g., a diskette or fixed disk), an optical memory device (e.g., a CD-ROM), a PC card (e.g., PCMCIA card), or other memory device.

Alternatively or additionally, the processor may include discrete electronic components coupled to a printed circuit board, integrated circuitry (e.g., Application Specific Integrated Circuits (ASIC)), and/or programmable logic devices (e.g., a Field Programmable Gate Arrays (FPGA)). Any of the methods and processes described above can be implemented using such logic devices.

Some of the methods and processes described above can be implemented as computer program logic for use with the computer processor. The computer program logic may be embodied in various forms, including a source code form or a computer executable form. Source code may include a series of computer program instructions in a variety of programming languages (e.g., an object code, an assembly language, or a high-level language such as C, C++, or JAVA). Such computer instructions can be stored in a non-transitory computer readable medium (e.g., memory) and executed by the computer processor. The computer instructions may be distributed in any form as a removable storage medium with accompanying printed or electronic documentation (e.g., shrink wrapped software), preloaded with a computer system (e.g., on system ROM or fixed disk), or distributed from a server over a communication network (e.g., the Internet).

Although closed loop control of directional drilling and certain advantages thereof have been described in detail, it should be understood that various changes, substitutions and alterations may be made herein without departing from the spirit and scope of the disclosure as defined by the appended claims.

Although only a few example embodiments have been described in detail above, those skilled in the art will readily appreciate that many modifications are possible in the example embodiments without materially departing from this invention.

Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

The invention claimed is:

1. A method for controlling drilling trajectory during directional drilling to a geological target, the method comprising:

providing or using a predictive controller that interfaces to and cooperates with a downhole trajectory control system to automatically control a drilling direction of a drilling tool during the directional drilling, wherein the predictive controller is configured to receive data representing a new reference trajectory for a given measured depth and generate output data representing a sequence of set-points for the new reference trajectory, wherein the predictive controller is further configured to communicate the output data to the downhole trajectory control system to automatically actuate one or more pistons to tilt a swivel of the drilling tool to control the drilling direction of the drilling tool to follow the new reference trajectory, wherein the predictive controller includes a model and optimizer, wherein the model embodies a transfer function for at least one closed-loop controller of the downhole trajectory control system, wherein the transfer function is configured to account for response of the at least one closed-loop controller to input data supplied thereto, and wherein the transfer function is a function of a gain in degrees per distance, a Laplace operator, a target inclination of the drilling tool, a measured inclination of the drilling tool, and an output steering power of the drilling tool.

2. The method of claim 1, wherein:

the drilling tool comprises a rotary steerable system (RSS).

3. The method of claim 1, wherein:

the set-points specify at least one of: dog leg severity, tool face, target inclination, and target azimuth for the new reference trajectory.

4. The method of claim 1, wherein:

the downhole trajectory control system includes an auto-curve controller that uses set-points of dog leg severity or tool face for the new reference trajectory to automate drilling of curved segments of the new reference trajectory.

5. The method of claim 1, wherein:

the downhole trajectory control system includes an attitude controller that uses set-points of target inclination and target azimuth for the new reference trajectory to automate drilling of segments of the new reference trajectory.

6. The method of claim 5, wherein:

the attitude controller implements a closed-loop control scheme configured to automatically hold the target inclination and the target azimuth.

7. The method of claim 1, wherein:

the model is configured to account for a variable sampling rate of the at least one closed-loop controller.

8. The method of claim 1, wherein:

the at least one closed-loop controller comprises an attitude controller that implements a closed-loop control scheme configured to automatically hold a target inclination and a target azimuth.

9. The method of claim 1, wherein:

the model is configured with different set-point excitations.

10. The method of claim 1, wherein:

the model is supplied with past and future inputs that represent dog leg severity (DLS) and tool face (TF) set-points.

11. The method of claim 10, wherein:

the future inputs represent optimized values for dog leg severity (DLS) and tool face (TF) set-points that will minimize error between the reference trajectory and a predicted trajectory.

12. The method of claim 10, wherein:

the model is configured to predict future outputs that represent inclination response and azimuth response of the downhole trajectory control system.

13. The method of claim 1, wherein:

the model and the optimizer are configured to perform a model-based predictive control method that produces dog leg severity (DLS) and tool face (TF) set-points over certain measured depth (MD) segments that minimize error between the new reference trajectory and a predicted trajectory based on the model.

14. The method of claim 13, wherein:

the new reference trajectory and the predicted trajectory are defined by at least one parameter selected from the group consisting of: true vertical depth (TVD), north/south and east/west, new reference inclination and/or azimuth, measured depth (MD) and vertical section (VS), or changes related to these parameters.

15. The method of claim 1, wherein:

the model and the optimizer employ convex optimization that include constraints and a cost function.

16. The method of claim 15, wherein:

the cost function is constructed as a combination of a difference of the new reference trajectory and a predicted trajectory and a sum of changes in the input data.

17. The method of claim 15, wherein:

the cost function is configured to minimize a number of changes in a dog leg severity (DLS) and a tool face (TF) to reach the geological target.

18. The method of claim 1, wherein:

the predictive controller and/or the downhole trajectory control system is embodied by a processor or controller.

19. The method of claim 1, wherein the transfer function is defined by an equation:

$$\frac{Inc(s)}{Inc_{sp}(s)} = \frac{K_c \cdot \text{Gain} \cdot \frac{1}{s}}{1 + K_c \cdot \text{Gain} \cdot \frac{1}{s}} = \frac{1}{\frac{1}{K_c \cdot \text{Gain}} \cdot s + 1}$$

wherein Gain is the gain of closed-loop control in degrees per distance, s is the Laplace operator, $Inc_{sp}$ is a set-point of the target inclination of the drilling tool, Inc is the measured inclination of the drilling tool, and K=output steering power/($Inc_{sp}$–Inc).

20. The method of claim 1, wherein the predictive controller is further configured to control the drilling direction of the drilling tool by adjusting a tool face and a steering ratio of the drilling tool using continuous real-time measurements to obtain the measured inclination and a measured azimuth.

* * * * *